US006684539B2

(12) United States Patent
Boulud et al.

(10) Patent No.: US 6,684,539 B2
(45) Date of Patent: Feb. 3, 2004

(54) IRON VAPORIZATION CHAMBER COATING

(75) Inventors: Henry Boulud, Dièmoz (FR); Bertrand Couet, Vienne (FR)

(73) Assignee: Seb S.A., Ecully (FR)

( * ) Notice: Subject to any disclaimer, the term of this patent is extended or adjusted under 35 U.S.C. 154(b) by 0 days.

(21) Appl. No.: 10/221,328

(22) PCT Filed: Mar. 6, 2001

(86) PCT No.: PCT/FR01/00661

§ 371 (c)(1),
(2), (4) Date: Sep. 11, 2002

(87) PCT Pub. No.: WO01/68971

PCT Pub. Date: Sep. 20, 2001

(65) Prior Publication Data

US 2003/0056407 A1 Mar. 27, 2003

(30) Foreign Application Priority Data

Mar. 15, 2000 (FR) ..... 00 03333

(51) Int. Cl.[7] ..... D06F 75/18
(52) U.S. Cl. ..... 38/77.83
(58) Field of Search ..... 38/77.83, 88, 77.8, 38/93; 219/245; 252/175, 179; 210/699, 660; 148/240

(56) References Cited

U.S. PATENT DOCUMENTS

| | | | | |
|---|---|---|---|---|
| 4,775,588 A | * | 10/1988 | Ishii et al. | 428/327 |
| 5,060,406 A | * | 10/1991 | Verweij et al. | 38/77.83 |
| 5,390,432 A | * | 2/1995 | Boulud et al. | 38/77.83 |
| 5,592,764 A | * | 1/1997 | Boulud et al. | 38/77.83 |
| 6,162,391 A | * | 12/2000 | Kowata et al. | 422/16 |

FOREIGN PATENT DOCUMENTS

| | | |
|---|---|---|
| EP | 0 425 043 | 10/1990 |
| EP | 0 592 334 | 9/1993 |
| FR | 2 522 318 | 2/1982 |
| FR | 2 707 732 | 7/1993 |
| FR | 2 757 364 | 12/1996 |
| GB | 773741 | 5/1957 |
| GB | 1176429 | 1/1970 |
| JP | 11147000 | 6/1999 |

* cited by examiner

*Primary Examiner*—Ismael Izaguirre
(74) *Attorney, Agent, or Firm*—Browdy and Neimark

(57) ABSTRACT

A cladding in a vaporization chamber of an iron, the cladding being composed of a first layer composed essentially of sodium silicate, and at least locally a second layer composed of a fiber mat or a hydrophilic fabric, wherein the cladding has a surface treated with a treatment product containing phosphorus and having an acid group.

13 Claims, 1 Drawing Sheet

IRON VAPORIZATION CHAMBER COATING

Figure 1:
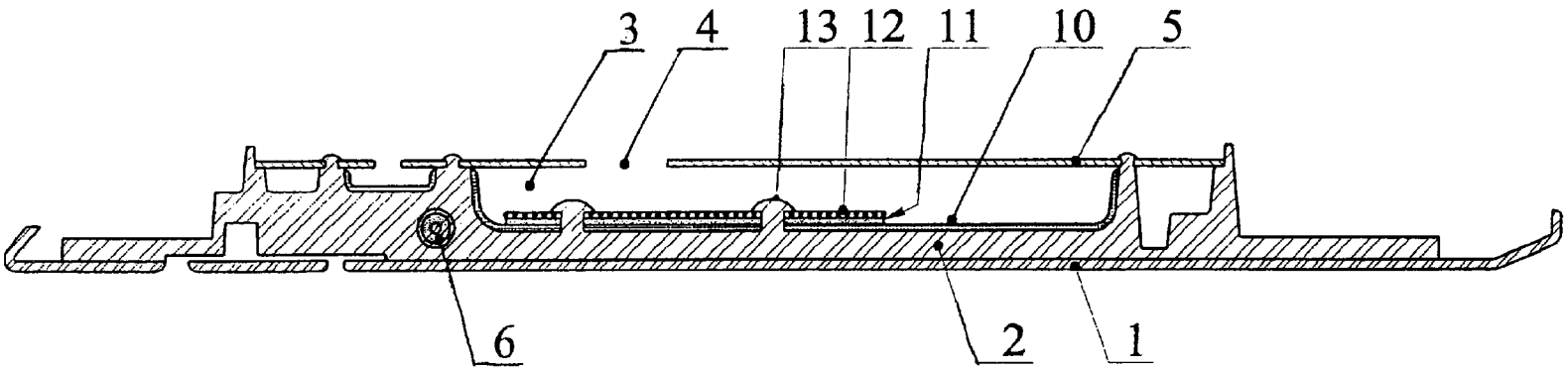

The present invention concerns steam irons.

These irons conventionally have a soleplate composed of a body generally made of cast aluminum, and a cap covering the lower part of the body and coming into contact with the items to be ironed. The body of the soleplate generally of aluminum comprises a heating element, a chamber for quasi-instantaneous vaporization of water and channels for distribution of the steam produced toward steam orifices directed onto the items through the cap.

The body of the soleplate must assure vaporization of the water as well as temperature maintenance of the cap.

The boiling temperature of water being constant in the vicinity of atmospheric pressure, the temperature of the wetted heating surface of an evaporator only varies with the vaporization power and thus the vapor flow rate. This surface temperature varies only slightly around 110–130° C. Conversely, the temperature of the heating body of the soleplate can be regulated depending on the fabrics over a range of the order of 80° C. to 200° C.

The vaporization chamber is coated on its wetted faces with a layer of a hydrophilic cladding having a low thermal conductivity which permits the wetted surface to remain at a temperature compatible with a good vaporization without calefaction, regardless of the temperature of the heating body, the extent of the wetted surface being adjusted with the flow rate of the water and the thermal flux.

There is known the patent FR 2696197 in which this spreading of water and wetting are aided. The cladding of the chamber is a silicate on which is placed a mat of fibers or a fabric retained by a grid that is able itself to be coated. The fibers have the advantage of increasing the specific surface of the wetted region while completing the thermal insulation, of storing and of distributing the water onto the surface of the chamber before it is vaporized.

Similarly, the patent FR 2707732 is known in which there is described a vaporization chamber the bottom of which is constituted by hydrophilic fibers partially embedded in the material constituting the heating body of the soleplate.

However, the cladding mainly composed of a silicate is sensitive to contamination and has a limited useful life. Moreover, the wettability of the fibers is generally obtained by removal of the oiling, which activates their surface but causes them to be susceptible to various forms of contamination, so that the problems of failure to vaporize can be periodically produced, characterized by an absence of wettability of the cladding, resulting in noise and sputtering of water through the vaporization holes of the soleplate.

It is known for example from the article "ceramics from A to Z" [la ceramique de A à Z], which appeared in 1977 in the periodical "Ceramic Industry" [L'Industrie Céramique] that phosphorous salts such as aluminum phosphate yield with silica compounds that are difficult to wash away. The patent EP 0425043 utilizes these properties to improve the deposition in steam iron vaporization chambers by starting from a solution of colloidal silica. But this patent does not suggest the use of sodium silicate as a base product for the deposition, silicate having the advantage of cleaning and pickling the surface of aluminum onto which is applied, while saponifying the fatty material that may be present, which simplifies that application process and permits a good anchoring of the following layers.

The patent FR 2522318 cites another property of phosphates, in particular sodium tripolyphosphate, which, solubilized in the water to be vaporized, impedes scaling up of the iron. Similarly, the patent FR 2757364 cites the utilization of sodium hexametaphosphate in the water to be vaporized in order to prevent scale from being deposited in a manner to form a crust in the iron. But these patents do not say anything with regard to improvement of the wettability of the vaporization chamber, and the cited products remain soluble.

It is equally known that phosphorous products of the organic type also have anti-scaling properties and equally properties of stabilization of emulsions having very low concentration.

The invention described hereafter has for its object a cladding of a vaporization chamber for an iron improved in order to increase the useful life of the cladding, having a reduced susceptibility to contaminations as well as to scaling, and an excellent vaporization performance.

The object of the invention is achieved by a cladding of a vaporization chamber of an iron, this cladding initially having a layer composed essentially of sodium silicate, and at least locally a fiber mat or a hydrophilic fabric, noteworthy in that the initial cladding has received a surface treatment with a product containing phosphorus and having an acid group.

The phosphorous product reacts with the silicate in neutralizing the sodium and is bound with the remaining silica in order to constitute a body that is difficult to wash away. The reaction although incompletely analyzed is produced at the surface of the silicate deposit and preserves the attachment of the layer onto the support. The surface becomes chemically more neutral attaining a hydrogen potential (pH) of the order of 7 at the surface, which preserves it from accidental contaminations. The presence of the phosphorus permits an exceptional wettability to be obtained when hot, this including on the fibers that cannot be silicated, and the presence of these fibers permits a spreading of the water to be vaporized on a large surface, thus improving performance. The fibers thus permit retention of a greater quantity of the product issuing from the treatment.

Moreover, one notes that the deposits of tartar are less adherent to such a cladding.

Several phosphorous bodies are suitable for the treatment. One can utilize aluminum triphosphate for example, but, Preferably the treatment product is a phosphonate for example phosphonic-trimethylene-amino acid in solution in water.

With respect to the utilization of inorganic products and with equal result the utilization of phosphonates is advantageous because it suffices to have a maximum quantity by weight that is ten times less. The process and the installations for pollution control that can be associated therewith are simplified.

Advantageously, the treatment product has an addition product such as a sodium molybdate, a diacetate of molybdenum, a chloride of calcium or of magnesium aiding the bonding of the deposited layers.

This complementary product assures a better cohesion of the treated surface.

Advantageously the treatment product contains colloidal silica.

The layer of silicate is found to be reinforced thereby and the fibers better coated.

Advantageously, the cladding is obtained by evaporation of a solution of the treatment product in the chamber preliminarily coated with sodium silicate and at least locally with fibers.

This solution permits a good distribution of the treatment product and a good reaction with the initial cladding.

The invention will be better understood from a reading of the example below and from the attached drawing.

FIG. 1 is a view in longitudinal cross section in a vertical plane of a steam iron soleplate having a coated vaporization chamber, the soleplate being horizontal. Only the initial cladding of the chamber is represented.

In a preferred version of the invention, a steam iron has a soleplate composed of a cap 1 constituting the ironing surface, a heating body 2 of aluminum and in thermal connection with this cap. The heating body comprises a heating element 6 and a chamber 3 for the vaporization of water coming from a droplet source positioned on an opening 4 of the closing plate 5 of the steam chamber.

The cladding of vaporization chamber 3 is composed of an initial cladding on which, according to the invention, is applied a treatment product increasing the vaporization performance of the chamber.

The initial cladding of vaporization chamber 3 has a layer 10 of sodium silicate adhering strongly to the wall of heating body 2 of aluminum. On this layer is deposited a fabric 11 of glass fibers from which the oiling has been removed after fabrication. A grid 12 maintained by rivets 13 emanating from heating body 2 fixes the fabric of fibers 11. Fabric 11 covers at least the part of chamber 2 that receives the drops of water, in line with opening 4 of closing plate 5.

In another version, fabric 11 is fixed on heating body 2 by grid 12. The silicate, then deposited, impregnates fabric 11.

In a preferred version, silicate layer 10 is reinforced by evaporation of a solution of colloidal silica in vaporization chamber 3.

According to a preferred version of the invention the treatment product is a solution in water of a phosphonic acid such as phosphonic-trimethylene-amino acid. This product is spread out in solution on the initial cladding at a rate of around two micrograms per square centimeter of cladding surface then the solution reacting with the initial cladding is evaporated.

Advantageously, the treatment product has a bonding element such as sodium molybdate, and possibly a reinforcing agent such as colloidal silica.

According to a practical form of construction of the invention, a solution of silicate is evaporated in vaporization chamber 3, then after cooling, glass fabric 11 is fixed with grid 12 in order to obtain the initial cladding, then 15 ml of a solution of 3% of silica and 0.3% of phosphonate is evaporated in the vaporization chamber and the final cladding is obtained, the indicative values cited corresponding to 25 square centimeters of chamber surface.

The initial cladding of a known type has good adherence to the wall of heating body 2. This initial cladding is affected at the surface by the treatment, but the bonding in depth with support 2 is not affected, which gives the cladding according to the invention a good adherence. Neutralization of the basic surface of the initial cladding reduces the sensitivity of the cladding according to the invention to various contaminations and the presence of phosphorus gives it very useful characteristics of wettability when hot.

What is claimed is:

1. A cladding in a vaporization chamber of an iron, said cladding comprising a first layer composed essentially of sodium silicate, and at least locally a second layer composed of a fiber mat or a hydrophilic fabric, wherein said cladding has a surface treated with a treatment product containing phosphorus and having an acid group.

2. The cladding according to claim 1 wherein said first and second layers are bonded together, and the treatment product has an addition product selected from a sodium molybdate, a diacetate of molybdenum, and a chloride of calcium or of magnesium aiding the bonding of said first and second layers.

3. The cladding according to claim 1 wherein the treatment product contains colloidal silica.

4. The cladding according to claim 1 wherein the cladding is obtained by evaporation of a solution of the treatment product in the chamber preliminarily coated with sodium silicate and at least locally with fibers.

5. The cladding according to claim 1 wherein the treatment product is a phosphonate in solution in water.

6. The cladding according to claim 5 wherein the phosponate is phosphonic-trimethylene-amino acid.

7. The cladding according to claim 5 wherein the treatment product contains colloidal silica.

8. The cladding according to claim 5 wherein the cladding is obtained by evaporation of a solution of the treatment product in the chamber preliminarily coated with sodium silicate and at least locally with fibers.

9. The cladding according to claim 5 wherein said first and second layers are bonded together, and the treatment product has an addition product selected from a sodium molybdate, a diacetate of molybdenum, and a chloride of calcium or of magnesium aiding the bonding of said first and second layers.

10. The cladding according to claim 9 wherein the cladding is obtained by evaporation of a solution of the treatment product in the chamber preliminarily coated with sodium silicate and at least locally with fibers.

11. The cladding according to claim 9 wherein the treatment product contains colloidal silica.

12. The cladding according to claim 11 wherein the cladding is obtained by evaporation of a solution of the treatment product in the chamber preliminarily coated with sodium silicate and at least locally with fibers.

13. A vaporization chamber of an iron and a cladding on at least a portion of a surface of said vaporization chamber, wherein said cladding is formed by:

providing a layer composed essentially of sodium silicate and at least locally a fiber mat or a hydrophilic fabric; and treating the surface of said cladding with a treatment product containing phosphorus and having an acid group.

* * * * *